US006101652A

United States Patent [19]

Matern, Jr.

[11] Patent Number: 6,101,652

[45] Date of Patent: Aug. 15, 2000

[54] STIRRUPS

[76] Inventor: Maximillian Matern, Jr., 26 Lafayette St., Rumson, N.J. 07760

[21] Appl. No.: 09/391,841

[22] Filed: Sep. 8, 1999

[51] Int. Cl.[7] ..... A61G 13/00; A47C 20/04; A47C 20/02

[52] U.S. Cl. ..... 5/648; 5/649; 5/929

[58] Field of Search ..... 5/648, 649, 650, 5/651, 624, 426, 929

[56] References Cited

U.S. PATENT DOCUMENTS

| | | | |
|---|---|---|---|
| 358,513 | 3/1887 | Walton . | |
| 542,390 | 7/1895 | Linn | 5/624 |
| 784,425 | 3/1905 | Phillips | 5/649 |
| 828,007 | 8/1906 | Williams | 5/624 |
| 1,894,739 | 1/1933 | Gilbert | 5/624 |
| 2,978,713 | 4/1961 | Scalzitti et al. . | |
| 3,227,439 | 1/1966 | Carlson . | |
| 3,227,440 | 1/1966 | Scott . | |
| 3,817,512 | 6/1974 | Torrey | 5/648 |
| 3,907,270 | 9/1975 | Ezzo | 5/648 |
| 4,239,200 | 12/1980 | Sarrafian et al. . | |
| 4,940,286 | 7/1990 | Nguti | 5/508.1 |

*Primary Examiner*—Alexander Grosz
*Attorney, Agent, or Firm*—Caesar, Rivise, Bernstein, Cohen & Pokotilow, Ltd.

[57] ABSTRACT

A foldable leg stirrups for use during sex or medical examination that can be concealed, after use, between the mattress/box spring of a bed, or under the seat cushion(s) of a couch or chair, or between the mattress/cushion and frame of an examination table.

11 Claims, 3 Drawing Sheets

STIRRUPS

FIELD OF THE INVENTION

This invention relates leg stirrups, and more particularly, to a foldable and concealable leg stirrups.

BACKGROUND OF THE INVENTION

U.S. Pat. No. 784,425 (Phillips) discloses a portable stirrups device which comprises (1) a flat support surface for placement on a table or bed and for supporting the buttocks of the user; (2) stirrups or foot-rests that are secured to the flat support and (3) a clamping mechanism for rigidly securing the device to the bed, i.e., for clamping to the side rail of a bed.

U.S. Pat. No. 828,007 (Williams) discloses a portable and collapsible operating table that comprises (1) an intermediate portion for supporting the buttocks/back of a patient and (2) integral and rigid foot rests including heel rests. The device can be placed on a bed or bench or even used as a stretcher.

U.S. Pat. No. 1,894,739 (Gilbert) also discloses a portable and collapsible surgical operating table having a foldable central portion for supporting the buttocks or back of the patient and which includes knee rests, rather than foot rests.

U.S. Pat. No. 2,978,713 (Scalizitti et al.) discloses a portable examining table that comprises a central flat support portion upon which the patient lies and which anchors the table on a bed without the need for any mechanical attachment to the bed (col. 3, lines 5–7). A pair of knee rests are adjustably coupled to respective upstanding, side portions.

U.S. Pat. No. 3,227,439 (Carlson) discloses an operating table that utilizes leg support portions 15 that pivot about a vertical axis 16. See also U.S. Pat. No. 3,227,440 (Scott) and U.S. Pat. No. 4,239,200 (Sarrafian et al, FIG. 5). Stirrups having leg holders that laterally pivot are shown in U.S. Pat. No. 358,513 (Walton).

U.S. Pat. No. 3,907,270 (Ezzo) discloses a portable examining table that comprises a central flat support for placement on a table with a transverse/bent and leg support member rotatably secured to one end of the flat support. A pair of molded plastic stirrups is fixed on opposite side of the transverse leg support. When the examining table is placed on a table or other surface along with the transverse/bent support member, the patient, with the buttocks on the central portion, can slip her feet into the stirrups.

U.S. Pat. No. 4,940,286 (Nguti) discloses a bed attachment that comprises a buttocks support section 28 and having right 40 and left 40 support sections that can pivot in a lateral direction to assist in sexual activity, especially for arm amputees or other handicapped individuals.

However, it is apparent that none of these devices can be concealed between the mattress of a bed or couch without disturbing the use of the bed or couch when use of the leg stirrups is complete. Thus, there remains a need for a foldable stirrups that can be concealed between the mattress of a bed or a couch when the stirrups is not in use.

OBJECTS OF THE INVENTION

Accordingly, it is the general object of this invention to provide an apparatus which addresses the aforementioned needs.

It is a further object of this invention to provide a leg stirrups apparatus that can be concealed between the mattress and box spring of a bed without disturbing the use of the bed when use of the leg stirrups is complete.

It is yet another object of this invention to provide a leg stirrups apparatus that can be concealed under the cushion(s) of a couch or chair without disturbing the use of the couch or chair when use of the leg stirrups is complete.

It is a further object of this invention to provide a leg stirrups apparatus that can be concealed between the mattress and frame of an examination table without disturbing the use of the examination table when use of the leg stirrups is complete.

It is still yet another object of this invention to provide a leg stirrups apparatus that can be used on top of a bed and after use can be concealed between the mattress and box spring of the bed without disturbing the use of the bed when use of the leg stirrups is complete.

It is still even yet another object of this invention to provide a leg stirrups apparatus that can be used on top of a couch or chair and after use can be concealed under the cushion(s) of the couch or chair without disturbing the use of the couch or chair when use of the leg stirrups is complete.

It is still yet another object of this invention to provide a leg stirrups apparatus that can be used on top of an examination table and after use can be concealed between the mattress and frame of the examination table without disturbing the use of the examination table when use of the leg stirrups is complete.

It is even yet a further object of this invention to provide a leg stirrups apparatus, including collapsible foot supports, that can be used on top of a couch or chair and after use can be concealed under the cushion(s) of the couch or chair without disturbing the use of the couch or chair when use of the leg stirrups is complete.

It is still yet another object of this invention to provide a leg stirrups apparatus, including collapsible foot supports, that can be used on top of an examination table and after use can be concealed between the mattress and frame of the examination table without disturbing the use of the examination table when use of the leg stirrups is complete.

SUMMARY OF THE INVENTION

These and other objects of the instant invention are achieved by providing a stirrups device for use with a bed having a mattress and box spring, a couch with seat cushions or an examination table having a mattress and frame. The stirrups device supports the buttocks and legs of a person during sex or medical examination. The stirrups device comprises: a buttocks plate for supporting, directly or indirectly, the buttocks of the person during sex or medical examination; a pair of leg supports pivotally coupled to the buttocks plate for supporting the legs of the person during sex or medical examination; and wherein after sex or medical examination, the pair of leg supports can be pivoted towards the buttocks plate to form a compact device that can be concealed between the mattress and the box spring, or concealed under the seat cushions of the couch, or concealed between the mattress and the frame of the examination table without disturbing the use of the bed, couch or examination table.

DESCRIPTION OF THE DRAWINGS

Other objects and many of the attendant advantages of this invention will be readily appreciated as the same becomes better understood by reference to the following detailed description when considered in connection with the accompanying drawings wherein.

DESCRIPTION OF THE PREFERRED EMBODIMENT OF THE INVENTION

Figure 1:
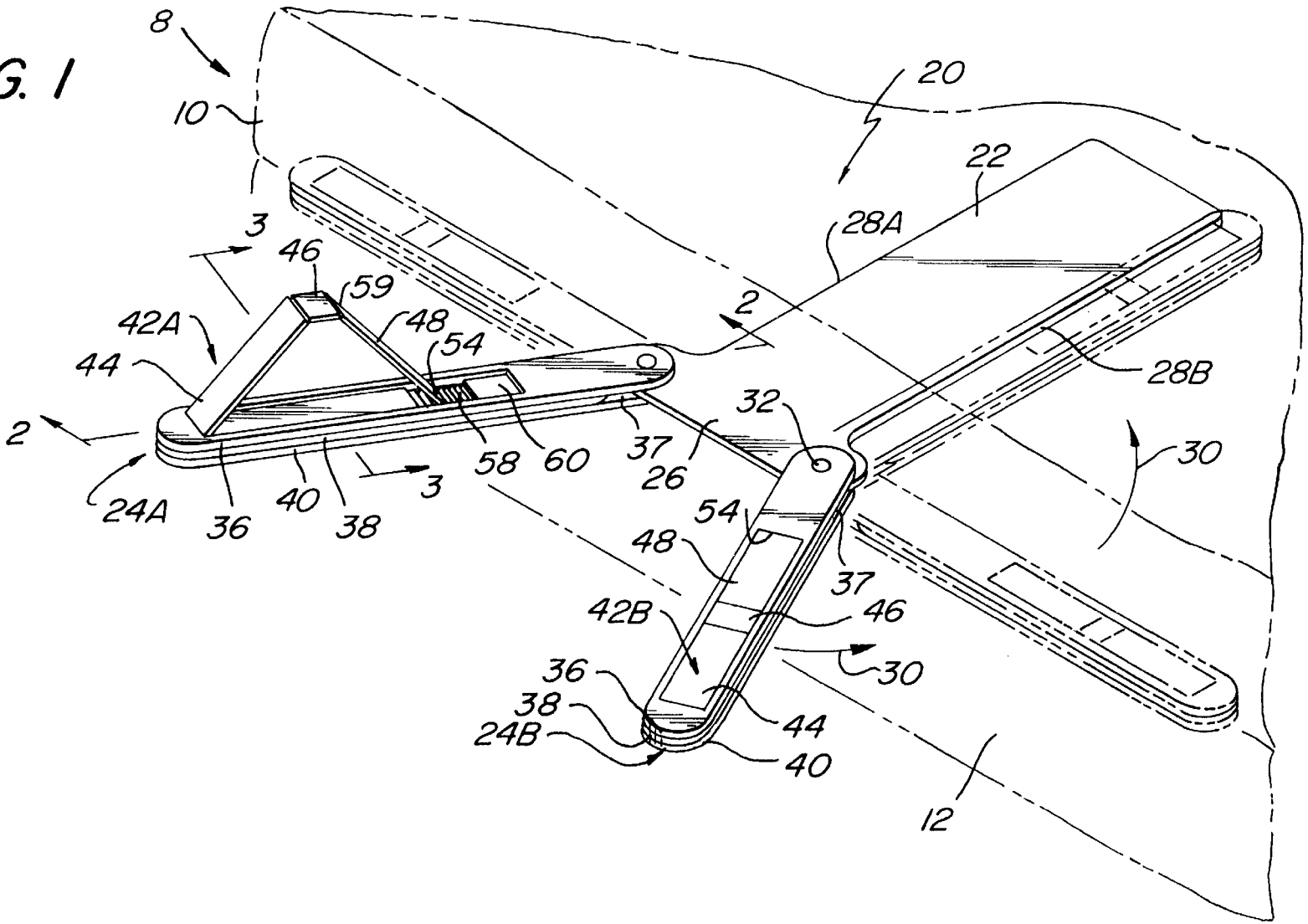
FIG. 1 is an isometric view of the foldable stirrups showing the buttocks plate positioned between a bed mattress and box spring with the legs pivoted outwards and with one of the foot supports in a deployed position and with the legs pivoted to be positioned between the mattress (shown in phantom) also.

Referring now in greater detail to the various figures of the drawing wherein like reference characters refer to like parts, a foldable stirrups for use during sex or medical examination constructed in accordance with the present invention is shown generally at in FIG. 1. The device 20 comprises a buttocks plate 22 and pivoting leg supports 24A and 24B, all of which form a substantially planar stirrups device that, when not in use, can be concealed under the cushions of a couch, between the bed mattress/box spring of a bed, or between an examination table mattress and frame without disturbing the use of the couch, bed or examination table.

In particular, the buttocks plate 22 comprises an elongated member having a wider front end 26 with narrowed or contoured sides 28A/28B. These contoured sides 28A/28B permit the respective leg supports 24A and 24B to be swung backwards (as indicated by the arrow 30) and positioned closely adjacent the sides 28A/28B, thereby forming a compact device that can be readily concealed between a bed mattress 10 and a box spring 12 of a bed 8 without disturbing the use of such bed 8 when the device 20 is concealed.

Each leg support 24A and 24B is pivotally coupled to a corner of the front end 26 of the buttocks plate 22. A fastener 32 (FIG. 2), positioned in aperture 34, pivotally secures one end of each leg support 24A/24B to the buttocks plate 22. It should be understood that the pivotal coupling disclosed herein is by way of example only and that any equivalent means or method of pivotally coupling leg supports 24A/24B to the buttocks plate 22 is within the broadest scope of this invention.

Figure 2:
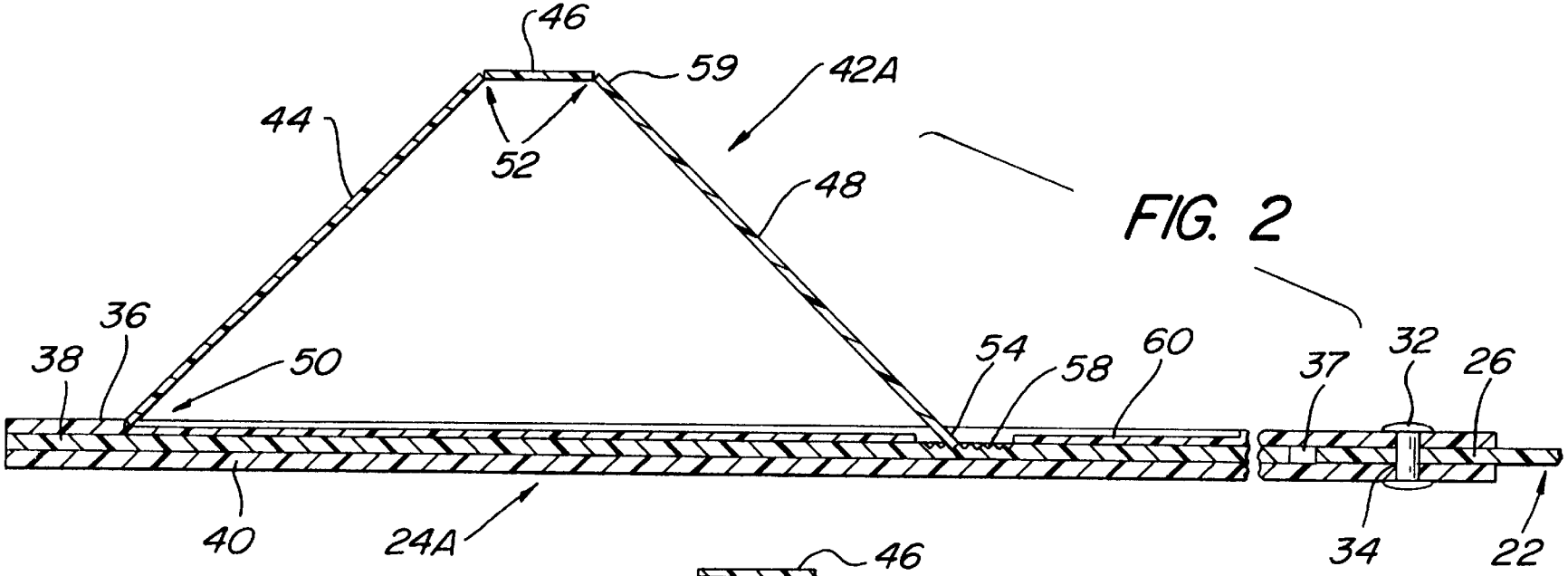
FIG. 2 is a cross-sectional view of the invention taken along line 2—2 of FIG. 1.

As shown most clearly in FIG. 2, each leg support 24A and 24B comprises a three elongated layer composition for strength: a top layer 36, a middle layer 38 and a bottom layer 40, and all of which may be approximately ¼ inch in thickness. The middle layer 38 has a shorter length than the top 36 and bottom layers 40 in order to provide a clearance gap 37 to avoid interfering with leg pivoting. The layers are fixedly secured to each other (e.g., using an adhesive, fastening means or any equivalent thereof).

It should be understood that this three layer composition is by way of example only and that any equivalent means (e.g., a unitary leg support that provides similar strength) could be used for the leg supports 24A and 24B.

Figure 3:
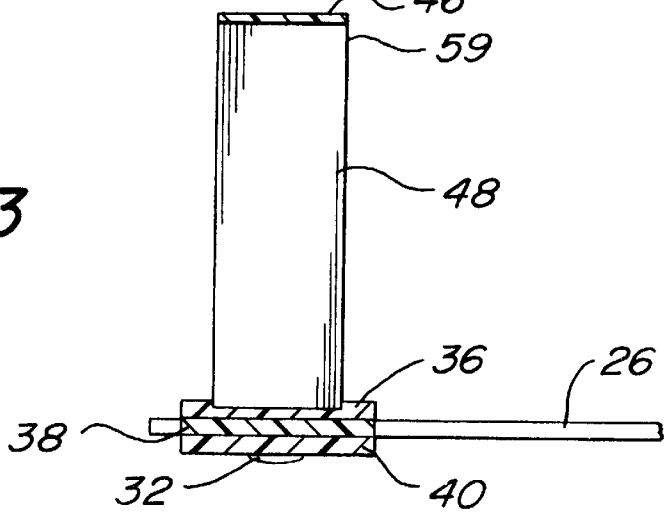
FIG. 3 is a cross sectional view of the invention taken along line 3—3 of FIG. 1.

To facilitate supporting a user's leg on each support 24A/24B, a respective collapsible foot rest 42A and 42B is provided therein; an erect foot rest 42A and a collapsed foot rest 42B are shown in FIG. 1. In particular, each foot rest 42A/42B comprises a three element design: a hinged front member 44, a central-connecting member 46 and a foot-support member 48. In a collapsed state, these three members form a portion of the top layer 36, as shown by the collapsed foot support 42B in leg support 24B in FIG. 1. The front member 44 is hinged in the top layer 36 using any conventional hinge design (e.g., a living hinge, a transverse pin, etc. or any equivalent means) at the location indicated by 50 (FIG. 2). The central-connecting member 46 connects the front member 44 to the foot-support member 48 and the central-connecting member 46 is hinged at both ends (indicated by location 52, FIG. 2) to members 44 and 48 using any conventional hinge design (e.g., a living hinge, a transverse pin, etc. or any equivalent means). The foot-support member 48 has a free end 54 that can be positioned along the axis (56, see FIG. 4) of the leg support 24A/24B in one of a series of teeth 58 in each leg support 24A/24B. These series of teeth 58 are positioned in the upper surface 60 of the middle layer 38 of each leg support 24A/24B. Thus, when each foot support 42A and 42B is to be erected, the free end 54 of each foot support member 48 is displaced forward (see arrow 62 in FIG. 4) along the axis 56 which causes the other end 59 of the foot support member 48 to elevate (see FIG. 3), along with the front member 44 and the central-connecting member 46. The particular incline of the foot support member 48 can then be adjusted by selecting a particular tooth position in the series of teeth 58. To collapse the foot supports 42A/42B, the opposite procedure is followed.

It should be understood that the collapsible foot supports 42A and 42B disclosed herein are by way of example only and that any equivalent collapsible foot support is within the broadest scope of this invention. The key feature is that the foot supports are collapsible to support the substantially planar design of the device 20 when concealing the device 20, as discussed previously.

The buttocks plate 22, leg supports 24A/24B and foot supports 42A/42B may comprise, but are not limited to, any durable material and/or lightweight material such as plastic (e.g, a strong plastic such as plexiglass).

Figure 4:
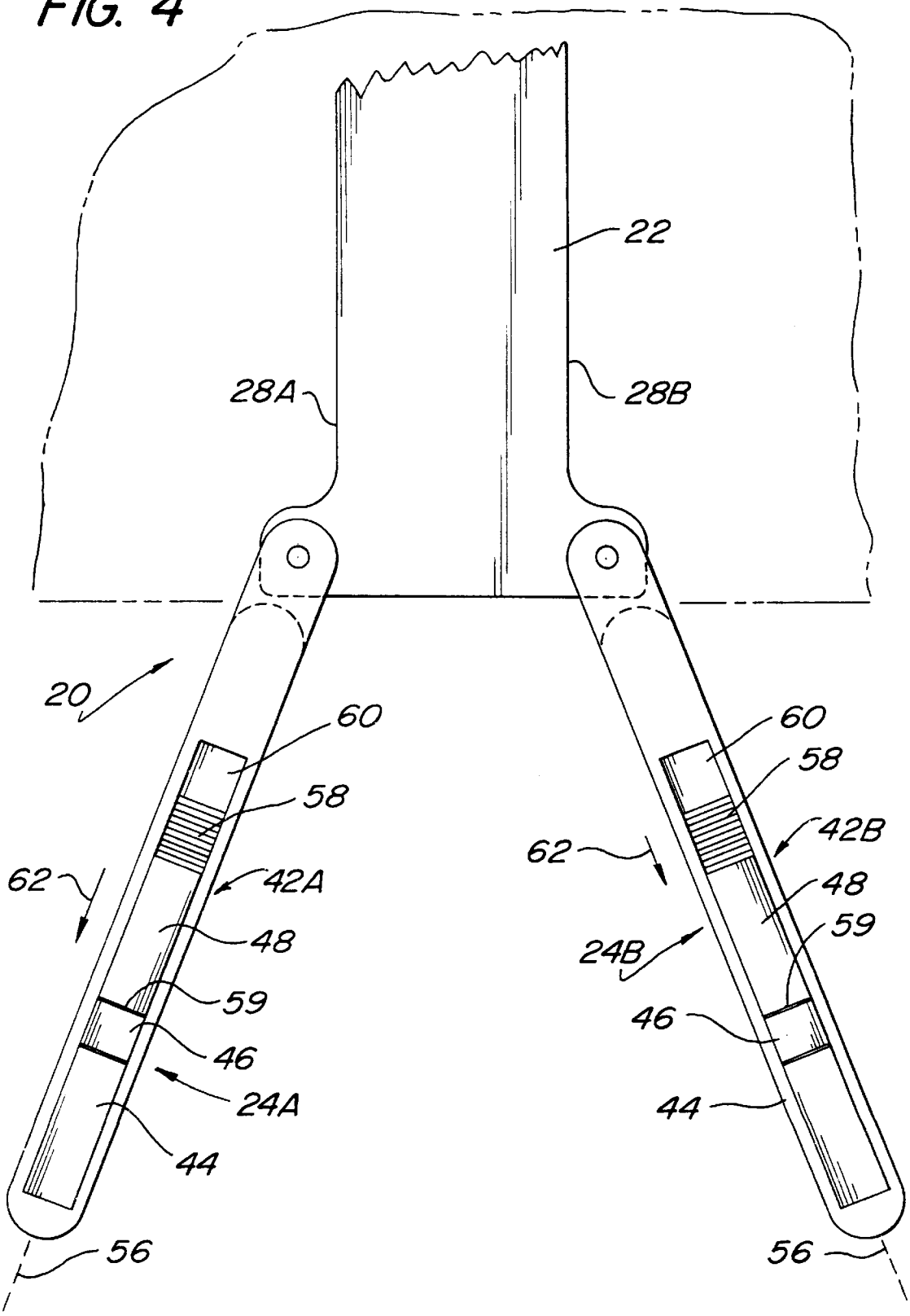
FIG. 4 is a top plan view of the invention showing the buttocks plate positioned between a bed mattress and box spring (shown in phantom) with the foot supports in erected positions.

It should be understood that the bed mattress 10 and the box spring 12 of bed 8 shown in FIGS. 1 and 4 are exemplary only in that the bed mattress 10 shown may also represent a cushion of a chair or couch, with the box spring 12 representing the chair or couch frame. Alternatively, the bed mattress 10 may represent an examination table mattress or cushion and the box spring 12 may represent the examination table frame. Thus, the use of the device 20 is not limited to beds, chair, couches and examination tables but includes any reclining or seating device where the weight of the user is transferred to the buttocks plate 22 and the user's legs can be supported on the respective leg supports 24A/24B.

In operation, the leg supports 24A/24B are pivoted away from the buttocks plate 22 (i.e., in the opposite direction of the arrow 30, FIG. 1) into the forward position. The patient or user (not shown) places his/her buttocks either (1) directly on the buttocks plate 22 when the device 20 is used on top of a bed, couch, chair, examination table, etc., or (2) on the mattress of the bed, examination table, etc., or on the cushion of the couch, chair, etc., under which the buttocks plate 22 is positioned (i.e., indirect use). Thus, the device 20 can be used either on top of the bed/couch or it can be used with the buttocks plate 22 positioned between the bed mattress 10/box spring 12 or under the cushions of a couch or chair. Next, the foot supports 42A/42B are then erected and the device 20 is ready for use.

In either case, when use of the device 20 is complete, the foot supports 42A/42B are collapsed, the leg supports 24A/24B pivoted around to be adjacent the buttocks plate 22 and the entire compact device 20 can then be slid underneath the cushions of the couch, or between the bed mattress 10/box spring 12, or under the couch/chair cushions without disturbing the use of the bed 8 or the couch/chair.

Without further elaboration, the foregoing will so fully illustrate my invention that others may, by applying current or future knowledge, readily adopt the same for use under various conditions of service.

I claim:

1. A stirrups device for use with a bed having a mattress and box spring, a couch with seat cushions or an examination table having a mattress and frame, said stirrups device supporting the buttocks and legs of a person during sex or medical examination, said stirrups device comprising:

a buttocks plate for supporting, directly or indirectly, the buttocks of the person during sex or medical examination, said buttocks plate defining a first plane;

a pair of leg supports pivotally coupled to said buttocks plate for supporting the legs of the person during sex or medical examination, said pair of leg supports being pivotal in a second plane that is substantially parallel to said first plane; and wherein after sex or medical examination, said pair of leg supports can be pivoted towards said buttocks plate to form a compact device that can be concealed between the mattress and the box spring, or concealed under the seat cushions of the couch, or concealed between the mattress and the frame of the examination table without disturbing the use of the bed, couch or examination table.

2. The stirrups device of claim 1 wherein said buttocks plate is elongated.

3. The stirrups device of claim 2 wherein said buttocks plate comprises contoured sides for receiving respective leg supports when said respective leg supports are pivoted toward said buttocks plate to form said compact device.

4. The stirrups device of claim 3 wherein each of said leg supports comprises a collapsible foot rest, said foot rest being erected to support a respective foot of the person at an incline during sex or medical examination.

5. The stirrups device of claim 4 wherein each of said collapsible foot rest is adjustable for different inclines.

6. The stirrups device of claim 5 wherein said collapsible foot rest comprises:

a first member having a first and second end, said first end being hingedly coupled to said leg support;

a second member having a third and fourth end, said third end being hingedly coupled to said second end of said first member;

a third member having a fifth end and a sixth end, said fifth end of said third member being hingedly coupled to said fourth end of said second member and said sixth end comprising a free end; and a selective positioning means located in said leg support for receiving said free end of said third member.

7. The stirrups device of claim 3 wherein each of said leg supports comprises an upper elongated layer, a middle elongated layer and a bottom elongated layer that are fixedly secured to each other.

8. The stirrups device of claim 7 wherein each of said leg supports comprises a collapsible foot rest, said foot rest being erected to support a respective foot of the person at an incline during sex or medical examination.

9. The stirrups device of claim 8 wherein each of said collapsible foot rest is adjustable for different inclines.

10. The stirrups device of claim 9 wherein said collapsible foot rest comprises a portion of said upper elongated layer, said portion of said upper elongated layer comprising:

a first member having a first and second end, said first end being hingedly coupled to said upper elongated layer;

a second member having a third and fourth end, said third end being hingedly coupled to said second end of said first member; and a third member having a fifth end and a sixth end, said fifth end of said third member being hingedly coupled to said fourth end of said second member and said sixth end comprising a free end.

11. The stirrups device of claim 10 further comprising a selective positioning means located in a portion of said middle elongated layer for receiving said free end of said third member.

* * * * *